US007007705B1

(12) United States Patent
Thrower

(10) Patent No.: US 7,007,705 B1
(45) Date of Patent: Mar. 7, 2006

(54) FOOT MOBILITY AID

(76) Inventor: Martha Thrower, P.O. Box 1181 Rte. 82, Hopewell Junction, NY (US) 12533

( * ) Notice: Subject to any disclaimer, the term of this patent is extended or adjusted under 35 U.S.C. 154(b) by 0 days.

(21) Appl. No.: 10/700,949

(22) Filed: Oct. 31, 2003

(51) Int. Cl.
*A45B 1/00* (2006.01)

(52) U.S. Cl. ..... 135/65

(58) Field of Classification Search ..... 135/65, 135/72, 76; 602/23, 28, 29, 33; 36/71.5, 36/136; 748/79, 124, 125; 482/79, 124, 482/125

See application file for complete search history.

(56) References Cited

U.S. PATENT DOCUMENTS

| | | | | | |
|---|---|---|---|---|---|
| 1,304,153 | A | * | 5/1919 | Bugge | 602/4 |
| 2,607,340 | A | * | 8/1952 | Anderson | 602/4 |
| D207,770 | S | | 5/1967 | Loston | |
| 3,536,068 | A | * | 10/1970 | Stubbs | 128/878 |
| 3,739,772 | A | * | 6/1973 | Ennis | 602/4 |
| 3,828,370 | A | | 8/1974 | Ihmels | |
| 3,939,829 | A | * | 2/1976 | Spann | 128/878 |
| D244,869 | S | | 6/1977 | Manley et al. | |
| 4,121,827 | A | | 10/1978 | Weider | |
| 4,274,430 | A | * | 6/1981 | Schaaf et al. | 135/65 |
| 4,793,370 | A | * | 12/1988 | Perez et al. | 135/69 |
| 4,884,587 | A | * | 12/1989 | Mungons | 135/65 |
| 5,263,916 | A | * | 11/1993 | Bobich | 482/124 |
| 5,339,850 | A | * | 8/1994 | Mertz | 135/72 |
| 5,518,486 | A | * | 5/1996 | Sheeler | 482/131 |
| D373,011 | S | | 8/1996 | Rippel | |
| D381,787 | S | | 8/1997 | Littleton | |
| 5,718,673 | A | * | 2/1998 | Shipstead | 602/27 |
| 5,911,696 | A | * | 6/1999 | Coates | 602/4 |
| 6,004,282 | A | * | 12/1999 | Whitley | 602/5 |
| 6,361,517 | B1 | * | 3/2002 | Slinger | 602/28 |
| 2003/0213510 | A1 | * | 11/2003 | MacCready et al. | 135/65 |

* cited by examiner

*Primary Examiner*—Janet M. Wilkens

(57) ABSTRACT

A foot mobility aid for helping a user with limited mobility in a leg and foot help move the user's leg and foot when walking. The foot mobility aid includes an elongate flexible strap with a pair of opposite ends. One of the ends of the strap is folded back over an adjacent portion of the strap and coupled to the adjacent portion of the strap to form a foot loop for extending the foot of a user therein.

1 Claim, 2 Drawing Sheets

FOOT MOBILITY AID

BACKGROUND OF THE INVENTION

1. Field of the Invention

The present invention relates to devices for aiding the mobility of a user's foot and leg and more particularly pertains to a new foot mobility aid for helping a user with limited mobility in a leg and foot help move the user's leg and foot when walking.

2. Description of the Prior Art

The use of devices for aiding the mobility of a user's foot and leg is known in the prior art. More specifically, devices for aiding the mobility of a user's foot and leg heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,121,827 by Weider; U.S. Pat. No. 3,828,370 by Ihmels; U.S. Pat. No. Des. 244,869 by Manley et al.; U.S. Pat. No. Des. 207,770 by Loston; U.S. Pat. No. Des. 381,787 by Littleton; U.S. Pat. No. Des. 373,011 by Rippel.

While these devices fulfill their respective, particular objectives and requirements, the aforementioned patents do not disclose a new foot mobility aid. The inventive device includes an elongate flexible strap with a pair of opposite ends. One of the ends of the strap is folded back over an adjacent portion of the strap and coupled to the adjacent portion of the strap to form a foot loop for extending the foot of a user therein.

In these respects, the foot mobility aid according to the present invention substantially departs from the conventional concepts and designs of the prior art, and in so doing provides an apparatus primarily developed for the purpose of helping a user with limited mobility in a leg and foot help move the user's leg and foot when walking.

SUMMARY OF THE INVENTION

In view of the foregoing disadvantages inherent in the known types of devices for aiding the mobility of a user's foot and leg now present in the prior art, the present invention provides a new foot mobility aid construction wherein the same can be utilized for helping a user with limited mobility in a leg and foot help move the user's leg and foot when walking.

The general purpose of the present invention, which will be described subsequently in greater detail, is to provide a new foot mobility aid apparatus and method which has many of the advantages of the devices for aiding the mobility of a user's foot and leg mentioned heretofore and many novel features that result in a new foot mobility aid which is not anticipated, rendered obvious, suggested, or even implied by any of the prior art devices for aiding the mobility of a user's foot and leg, either alone or in any combination thereof.

To attain this, the present invention generally comprises an elongate flexible strap with a pair of opposite ends. One of the ends of the strap is folded back over an adjacent portion of the strap and coupled to the adjacent portion of the strap to form a foot loop for extending the foot of a user therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot mobility aid apparatus and method which has many of the advantages of the devices for aiding the mobility of a user's foot and leg mentioned heretofore and many novel features that result in a new foot mobility aid which is not anticipated, rendered obvious, suggested, or even implied by any of the prior art devices for aiding the mobility of a user's foot and leg, either alone or in any combination thereof.

It is another object of the present invention to provide a new foot mobility aid which may be easily and efficiently manufactured and marketed.

It is a further object of the present invention to provide a new foot mobility aid which is of a durable and reliable construction.

An even further object of the present invention is to provide a new foot mobility aid which is susceptible of a low cost of manufacture with regard to both materials and labor, and which accordingly is then susceptible of low prices of sale to the consuming public, thereby making such foot mobility aid economically available to the buying public.

Still yet another object of the present invention is to provide a new foot mobility aid which provides in the apparatuses and methods of the prior art some of the advantages thereof, while simultaneously overcoming some of the disadvantages normally associated therewith.

Still another object of the present invention is to provide a new foot mobility aid for helping a user with limited mobility in a leg and foot help move the user's leg and foot when walking.

Yet another object of the present invention is to provide a new foot mobility aid which includes an elongate flexible strap with a pair of opposite ends. One of the ends of the strap is folded back over an adjacent portion of the strap and coupled to the adjacent portion of the strap to form a foot loop for extending the foot of a user therein.

Still yet another object of the present invention is to provide a new foot mobility aid that paralyzed in a leg to move that leg when walking or for positioning the leg when sitting or getting up from a seated position.

Even still another object of the present invention is to provide a new foot mobility aid that helps a user with limited leg mobility exercise their leg by walking.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
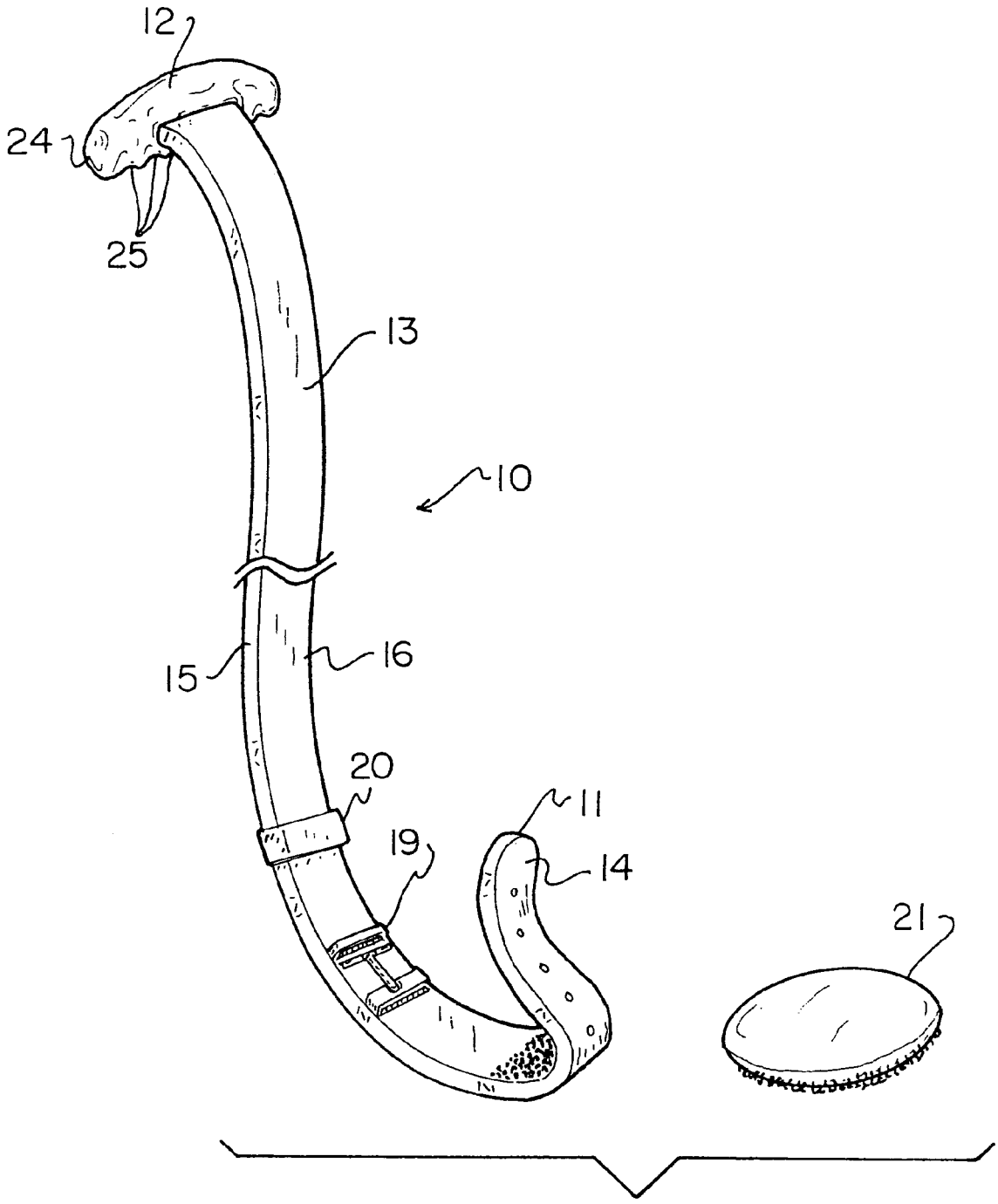
FIG. 1 is a schematic perspective view of a new foot mobility aid according to the present invention.
Figure 3:
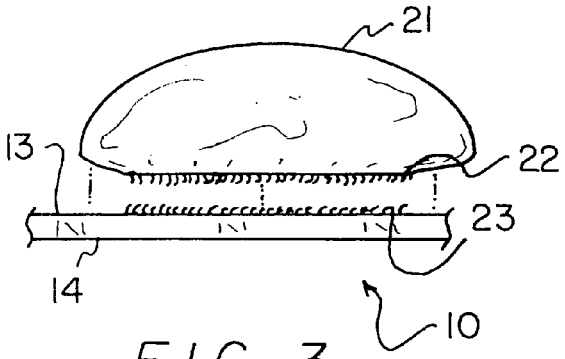
FIG. 3 is a schematic enlarged exploded side view of the coupling of the pad to the strap.
Figure 2:
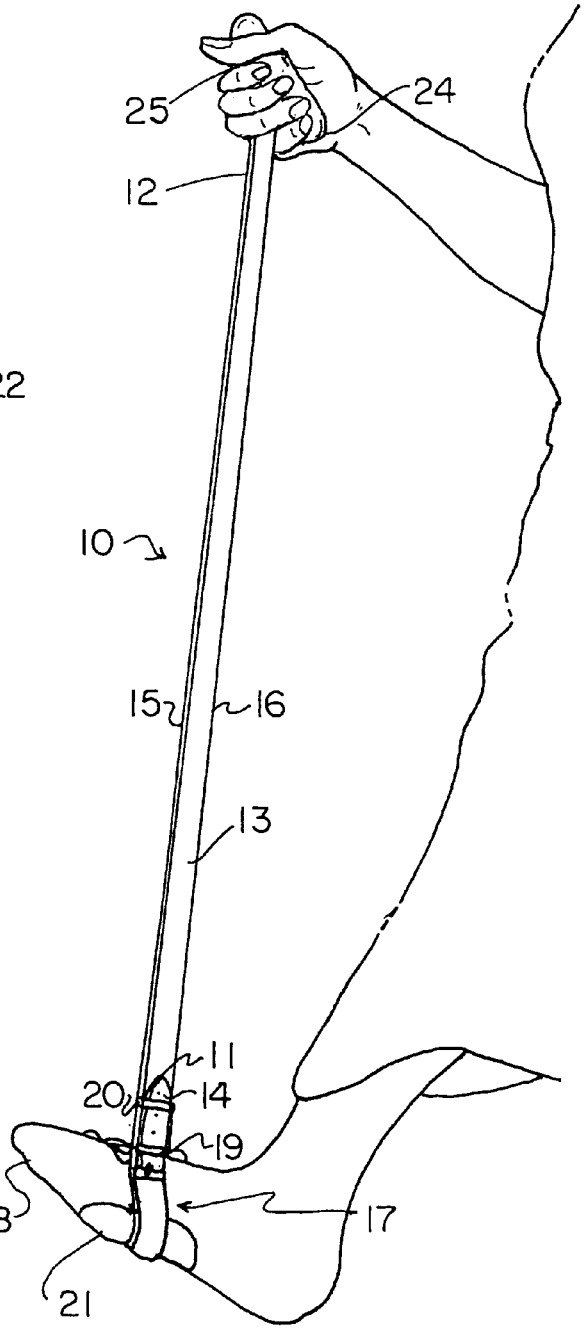
FIG. 2 is a schematic perspective view of the present invention in use.

With reference now to the drawings, and in particular to FIGS. 1 through 3 thereof, a new foot mobility aid embodying the principles and concepts of the present invention will be described.

As best illustrated in FIGS. 1 through 3, the foot mobility aid generally comprises an elongate flexible strap with a pair of opposite ends. One of the ends of the strap is folded back over an adjacent portion of the strap and coupled to the adjacent portion of the strap to form a foot loop for extending the foot of a user therein.

In closer detail, the foot mobility aid comprises an elongate flexible strap 10 with a pair of opposite ends 11,12. Preferably, the flexible strap has a generally rectangular transverse cross section and has a pair of opposite faces 13,14, and a pair of side edges 15,16 extending between the ends of the strap. The strap has a length defined between the ends of the strap and a width defined between the side edges of the strap. Preferably, the length of the strap is greater than about 2 feet. Even more preferably, the length of the strap is between about 3 feet and about 6 feet. Ideally, the length of the strap is about 5 feet for average height users. Preferably, the width of the strap is greater than about ½ inch for comfort of a user's foot. Even more preferably, the width of the strap is between about 1 inch and about 3 inches. Ideally, the width of the strap is about 2 inches for optimal comfort for a user's foot and flexibility of the strap.

A first of the ends 11 of the strap is folded back over an adjacent portion of the strap and coupled to the adjacent portion of the strap to form a foot loop 17 adjacent the first end of the strap. As illustrated in FIG. 2, the foot loop is designed for extending the foot 18 of a user therein such that the arch region of the user's foot is positioned in the foot loop. Ideally, a buckle 19 detachably couples the first end of the strap to the adjacent portion of the strap to permit adjusting of the size of the foot loop. The buckle is fixedly coupled to the adjacent portion of the strap and preferably has an end loop 20 for extending the first end of the strap therein.

Optionally, a resiliently deformable pad 21 may be coupled to the strap in the foot loop. Ideally, a hook and loop fastener detachably couples the pad to the strap in the foot loop. The hook and loop fastener has a pair of complementarily attachable portions 22,23. One of the portions is provided on the pad and the other of the portions is provided on the strap in the foot loop as best illustrated in FIG. 3.

Preferably, a handle 24 is coupled to a second of the ends of the strap. The handle is preferably extended substantially perpendicular to the length of the strap. Ideally, the handle has a plurality of finger grooves 25 for enhancing user comfort when grasping the handle. The handle preferably has a length of between about three inches and about six inches for providing sufficient size for a user to grasp the handle.

In use, a user extends their foot through the foot loop so that the arch of the foot is positioned adjacent the strap in the foot loop with the pad positioned underneath the arch of the foot. The user grasps the second end of the strap and pulls the strap to move and position the user's foot with the strap.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot mobility aid, comprising:

an elongate flexible strap having a pair of opposite first and second ends, a first end portion being positioned adjacent said first end;

said flexible strap having a generally rectangular transverse cross section and having a pair of opposite faces, and a pair of side edges extending between said ends of said strap;

said strap having a length defined between said ends of said strap and a width defined between said side edges of said strap;

wherein said length of said strap is about 5 feet;

wherein said width of said strap is about 2 inches for optimal comfort for a user's foot and flexibility of the strap;

a first of said ends of said strap being folded back over an adjacent portion of said strap and coupled to said adjacent portion of said strap to form a foot loop adjacent said first end of said strap;

said foot loop being adapted for extending the foot of a user therein such that the arch region of the user's foot is positioned in said foot loop;

a resiliently deformable pad being removably mounted on said strap in said foot loop, wherein a hook and loop fastener removably mounts said pad to said strap in said foot loop;

a handle being coupled to a second of said ends of said strap; and said handle being extended substantially perpendicular to said strap, said handle having a plurality of finger grooves;

means on said strap for adjusting an effective circumference of said foot loop formed by said strap, said means for adjusting an effective circumference of said foot loop comprising:

a plurality of apertures extending through said strap and being arranged substantially along a line extending from said first end toward said second end;

a buckle for detachably coupling said first end of said strap to a location on said strap between said first and second ends of said strap to form said foot loop, said buckle being mounted on said strap at a spaced location from said first end of said strap, said buckle defining an opening for receiving said first end portion of said strap, said buckle including a prong insertable into one of said apertures formed in said first end portion of said strap to adjust a position of said end portion of said strap with respect to said buckle to adjust a circumference of said foot loop.

* * * * *